US010978002B2

(12) United States Patent
Yue et al.

(10) Patent No.: US 10,978,002 B2
(45) Date of Patent: Apr. 13, 2021

(54) PIXEL CIRCUIT AND DRIVING METHOD THEREOF, AND DISPLAY PANEL

(71) Applicant: BOE TECHNOLOGY GROUP CO., LTD., Beijing (CN)

(72) Inventors: Han Yue, Beijing (CN); Minghua Xuan, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/632,989

(22) PCT Filed: Jun. 27, 2019

(86) PCT No.: PCT/CN2019/093359
§ 371 (c)(1),
(2) Date: Jan. 22, 2020

(87) PCT Pub. No.: WO2020/001554
PCT Pub. Date: Jan. 2, 2020

(65) Prior Publication Data

US 2020/0211464 A1 Jul. 2, 2020

(30) Foreign Application Priority Data

Jun. 29, 2018 (CN) ..... 201810701133.X

(51) Int. Cl.
*G09G 3/3258* (2016.01)
*G09G 3/3266* (2016.01)

(52) U.S. Cl.
CPC ..... *G09G 3/3258* (2013.01); *G09G 3/3266* (2013.01); *G09G 2300/0842* (2013.01); *G09G 2310/027* (2013.01); *G09G 2310/061* (2013.01)

(58) Field of Classification Search
CPC .. G09G 3/3233; G09G 3/3258; G09G 3/3266; G09G 2300/0842; G09G 3/3208; G09G 2310/027; G09G 2310/061
See application file for complete search history.

(56) References Cited

U.S. PATENT DOCUMENTS 7,612,499 B2 * 11/2009 Tsujimura ..... H01L 27/3204 313/505
2006/0001033 A1 * 1/2006 Tsujimura ..... H01L 27/3204 257/88

(Continued)

FOREIGN PATENT DOCUMENTS

CN 101147185 A 3/2008
CN 101996580 A 3/2011

(Continued)

OTHER PUBLICATIONS

International Search Report of PCT/CN2019/093359 in Chinese, dated Sep. 10, 2019, with English translation.

(Continued)

*Primary Examiner* — Dmitriy Bolotin
(74) *Attorney, Agent, or Firm* — Collard & Roe, P.C.

(57) ABSTRACT

Disclosed are a pixel circuit, a driving method thereof, and a display panel. The pixel circuit includes a driving circuit, a data writing circuit, a storage circuit, a light emitting circuit and a grayscale regulation circuit. The driving circuit includes a control terminal, a first terminal and a second terminal, and is configured to control a driving current; the data writing circuit is configured to write a data signal into the control terminal of the driving circuit; the storage circuit is configured to store the data signal; one terminal of the grayscale regulation circuit is connected with the second terminal of the driving circuit, another terminal thereof is connected with a first terminal of the light emitting circuit, and the grayscale regulation circuit is configured to regulate (Continued)

a voltage of the first terminal of the light emitting circuit according to the data signal in response to a switch driving signal.

16 Claims, 8 Drawing Sheets

(56) References Cited

U.S. PATENT DOCUMENTS

| | | | | |
|---|---|---|---|---|
| 2006/0164345 | A1* | 7/2006 | Sarma | G09G 3/30 345/76 |
| 2006/0220544 | A1* | 10/2006 | Okuyama | H01L 51/5203 313/506 |
| 2007/0115224 | A1* | 5/2007 | Yamamoto | G09G 3/3233 345/76 |
| 2011/0037054 | A1 | 2/2011 | Shieh et al. | |
| 2013/0037827 | A1* | 2/2013 | Levermore | H01L 27/3204 257/88 |
| 2013/0057532 | A1* | 3/2013 | Lee | G09G 3/3225 345/211 |
| 2016/0005384 | A1* | 1/2016 | Yoon | G09G 3/3233 345/213 |
| 2016/0267837 | A1 | 9/2016 | Wang et al. | |
| 2017/0025064 | A1 | 1/2017 | Sarma et al. | |
| 2017/0110052 | A1 | 4/2017 | Kuo | |
| 2017/0229070 | A1 | 8/2017 | Ma | |
| 2017/0278457 | A1* | 9/2017 | Zhu | G09G 3/3233 |
| 2018/0315374 | A1* | 11/2018 | Zhang | G09G 3/3258 |
| 2019/0206326 | A1 | 7/2019 | Wang et al. | |
| 2019/0251905 | A1 | 8/2019 | Yang et al. | |
| 2020/0035158 | A1 | 1/2020 | Yang et al. | |
| 2020/0303609 | A1* | 9/2020 | Yoon | H01L 33/62 |

FOREIGN PATENT DOCUMENTS

| | | | | |
|---|---|---|---|---|
| CN | 102576811 | A | 7/2012 | |
| CN | 103956138 | A | 7/2014 | |
| CN | 203773914 | U | 8/2014 | |
| CN | 104064149 | A | 9/2014 | |
| CN | 104392689 | A | 3/2015 | |
| CN | 104599637 | A | 5/2015 | |
| CN | 104916257 | A | 9/2015 | |
| CN | 106097964 | A | * 11/2016 | G09G 3/3233 |
| CN | 106448566 | A | 2/2017 | |
| CN | 107424570 | A | 12/2017 | |
| CN | 108039146 | A | 5/2018 | |
| CN | 110021263 | A | 7/2019 | |
| WO | 2020/007024 | A1 | 1/2020 | |

OTHER PUBLICATIONS

Chinese Office Action in Chinese Application No. 201810701133.X, dated Jul. 28, 2020 with English translation.

* cited by examiner

PIXEL CIRCUIT AND DRIVING METHOD THEREOF, AND DISPLAY PANEL

CROSS REFERENCE TO RELATED APPLICATIONS

This application is the National Stage of PCT/CN2019/093359 filed on Jun. 27, 2019, which claims priority under 35 U.S.C. § 119 of Chinese Application No. 201810701133.X filed on Jun. 29, 2018, the disclosure of which is incorporated by reference.

TECHNICAL FIELD

Embodiments of the present disclosure relate to a pixel circuit, a driving method thereof, and a display panel.

BACKGROUND

A Micro-LED display device can reduce the length of a light emitting diode (LED) to 1% of the original length, for example, to less than 100 microns (μm), and has advantages of higher luminous brightness, luminous efficiency and lower power consumption compared with an organic light emitting diode (OLED) display device, thereby having gradually attracted widespread attention. Due to the above characteristics. Micro-LED can be applied to devices with a display function, such as mobile phones, displays, notebook computers, digital cameras, instruments and meters, etc.

Micro-LED technology, i.e. LED miniaturization and matrixing technology, can prepare micro-LEDs displaying red, green and blue colors of micron level onto an array substrate, such as a silicon substrate. At the same time, each Micro-LED on the array substrate can be regarded as a single pixel, that is, it can be driven and lit separately, thus enabling the display device to present a picture with higher fineness and contrast.

SUMMARY

At least one embodiment of the present disclosure provides a pixel circuit, which includes a driving circuit, a data writing circuit, a storage circuit and a grayscale regulation circuit. The driving circuit includes a control terminal, a first terminal and a second terminal, and is configured to control a driving current flowing through the first terminal and the second terminal and used to drive a light emitting circuit to emit light, the first terminal of the driving circuit is configured to receive a first voltage from a first voltage terminal; the data writing circuit is connected with the control terminal of the driving circuit and is configured to write a data signal into the control terminal of the driving circuit; the storage circuit is connected with the control terminal of the driving circuit and is configured to store the data signal written by the data writing circuit; and one terminal of the grayscale regulation circuit is connected with the second terminal of the driving circuit, another terminal of the grayscale regulation circuit is connected with a first terminal of the light emitting circuit, and the grayscale regulation circuit is configured to regulate a voltage of the first terminal of the light emitting circuit according to the data signal in response to a switch driving signal.

For example, in a pixel circuit provided by an embodiment of the present disclosure, the light emitting circuit includes a plurality of light emitting elements connected in series.

For example, in the pixel circuit provided by an embodiment of the present disclosure, the driving circuit includes a first transistor, a gate electrode of the first transistor serves as the control terminal of the driving circuit, a first electrode of the first transistor serves as the first terminal of the driving circuit and is configured to be connected to the first voltage terminal to receive the first voltage, and a second electrode of the first transistor serves as the second terminal of the driving circuit.

For example, in the pixel circuit provided by an embodiment of the present disclosure, the data writing circuit includes a second transistor and a third transistor; a gate electrode of the second transistor is connected with a first scan line to receive a first scan signal, a first electrode of the second transistor is connected with a data line to receive the data signal, and a second electrode of the second transistor is connected with the control terminal of the driving circuit; and a gate electrode of the third transistor is connected with a second scan line to receive a second scan signal, a first electrode of the third transistor is connected with the data line to receive the data signal, and a second electrode of the third transistor is connected with the control terminal of the driving circuit.

For example, in the pixel circuit provided by an embodiment of the present disclosure, the data writing circuit includes a second transistor or a third transistor, a gate electrode of the second transistor is connected with a first scan line to receive a first scan signal, a first electrode of the second transistor is connected with a data line to receive the data signal, and a second electrode of the second transistor is connected with the control terminal of the driving circuit; and a gate electrode of the third transistor is connected with a second scan line to receive a second scan signal, a first electrode of the third transistor is connected with the data line to receive the data signal, and a second electrode of the third transistor is connected with the control terminal of the driving circuit.

For example, in the pixel circuit provided by an embodiment of the present disclosure, the storage circuit includes a storage capacitor, a first electrode of the storage capacitor is connected with the control terminal of the driving circuit, and a second electrode of the storage capacitor is connected with a third voltage terminal to receive a third voltage.

For example, in the pixel circuit provided by an embodiment of the present disclosure, the grayscale regulation circuit includes a fourth transistor, a gate electrode of the fourth transistor is connected with a switch driving signal line to receive the switch driving signal, a first electrode of the fourth transistor is connected to the second terminal of the driving circuit, and a second electrode of the fourth transistor is connected to the first terminal of the light emitting circuit.

For example, the pixel circuit provided by an embodiment of the present disclosure further includes a reset circuit, and the reset circuit is connected with a reset voltage terminal and the first terminal of the light emitting circuit, and is configured to apply a reset voltage to the first terminal of the light emitting circuit.

For example, in the pixel circuit provided by an embodiment of the present disclosure, the reset circuit includes a fifth transistor, a gate electrode of the fifth transistor is connected with a reset control line to receive a reset signal, a first electrode of the fifth transistor is connected with the reset voltage terminal to receive the reset voltage, and a second electrode of the fifth transistor is connected with the first terminal of the light emitting circuit.

At least one embodiment of the present disclosure further provides a display panel including a plurality of pixel units arranged in an array, and each of the plurality of pixel units includes the light emitting circuit and the pixel circuit provided by any embodiment of the present disclosure.

For example, in the display panel provided by an embodiment of the present disclosure, the light emitting circuit includes the first terminal and a second terminal, and the second terminal of the light emitting circuit is configured to receive a second voltage from a second voltage terminal.

At least one embodiment of the present disclosure further provides a driving method of a pixel circuit, and the driving method includes a light emitting stage; in the light emitting stage, input the switch driving signal to turn on the grayscale regulation circuit, so that the grayscale regulation circuit has a first cross voltage in a case where the light emitting circuit displays a first grayscale, and has a second cross voltage in a case where the light emitting circuit displays a second grayscale, thereby controlling the driving current flowing through the light emitting circuit according to the data signal and applying the driving current to the light emitting circuit; the first grayscale is less than the second grayscale, and the first cross voltage is greater than the second cross voltage.

For example, in the driving method of the pixel circuit provided by an embodiment of the present disclosure, the grayscale regulation circuit includes a transistor, the transistor operates in a saturation region in a case where the light emitting circuit displays the first grayscale, and the transistor operates in a linear region in a case where the light emitting circuit displays the second grayscale.

For example, the driving method of the pixel circuit provided by an embodiment of the present disclosure further includes: in the light emitting stage, inputting the data signal, a first scan signal and a second scan signal to turn on the data writing circuit and the driving circuit, so that the data writing circuit writes the data signal into the driving circuit, and the storage circuit stores the data signal.

For example, the driving method of the pixel circuit provided by an embodiment of the present disclosure further includes an initialization stage in a case where the pixel circuit includes a reset circuit; and in the initialization stage, input a reset signal to turn on the reset circuit, so that a reset voltage is applied to the first terminal of the light emitting circuit.

BRIEF DESCRIPTION OF THE DRAWINGS

In order to clearly illustrate the technical solutions of the embodiments of the disclosure, the drawings of the embodiments will be briefly described in the following; it is obvious that the described drawings are only related to some embodiments of the disclosure and thus are not limitative to the disclosure.

DETAILED DESCRIPTION

Figure 1A:
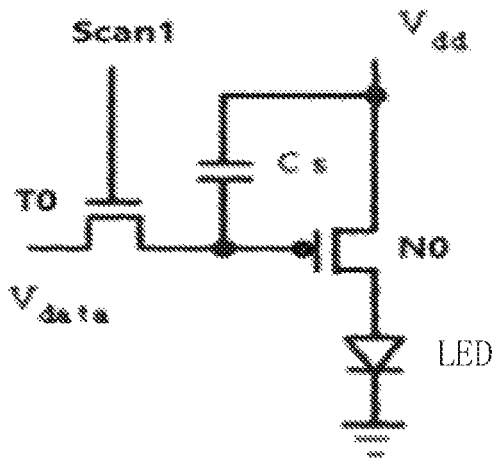
FIG. 1A is a schematic diagram of a 2T1C pixel circuit.

In order to make objects, technical details and advantages of the embodiments of the disclosure apparent, the technical solutions of the embodiments will be described in a clearly and fully understandable way in connection with the drawings related to the embodiments of the disclosure. Apparently, the described embodiments are just a part but not all of the embodiments of the disclosure. Based on the described embodiments herein, those skilled in the art can obtain other embodiment(s), without any inventive work, which should be within the scope of the disclosure.

Unless otherwise defined, all the technical and scientific terms used herein have the same meanings as commonly understood by one of ordinary skill in the art to which the present disclosure belongs. The terms "first," "second," etc., which are used in the present disclosure, are not intended to indicate any sequence, amount or importance, but distinguish various components. Also, the terms "comprise," "comprising," "include," "including," etc., are intended to specify that the elements or the objects stated before these terms encompass the elements or the objects and equivalents thereof listed after these terms, but do not preclude the other elements or objects. The phrases "connect". "connected", etc., are not intended to define a physical connection or mechanical connection, but may include an electrical connection, directly or indirectly. "On," "under," "right," "left" and the like are only used to indicate relative position relationship, and when the position of the object which is described is changed, the relative position relationship may be changed accordingly.

Hereinafter, various embodiments of the present disclosure will be described in detail with reference to the accompanying drawings. It should be noted that in the drawings, a same reference numeral is assigned to components having substantially the same or similar structures and functions, and repeated descriptions thereof will be omitted.

Figure 1B:
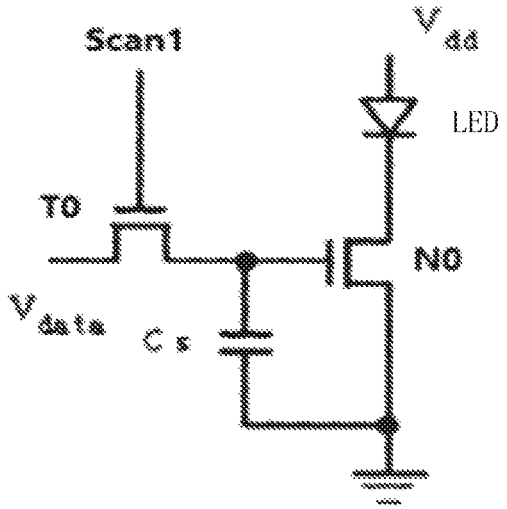
FIG. 1B is a schematic diagram of another 2T1C pixel circuit.

A basic pixel circuit used in Micro-LED display devices or OLED display devices is usually a 2T1C pixel circuit, which adopts two thin-Film transistors (TFTs) and a storage capacitor Cs to realize the basic function of driving a light emitting element LED to emit light. FIG. 1A and FIG. 1B are schematic diagrams respectively showing two kind of 2T1C pixel circuits.

As shown in FIG. 1A, a 2T1C pixel circuit includes a switching transistor T0, a driving transistor N0, and a storage capacitor Cs. For example, a gate electrode of the switching transistor T0 is connected to a scan line (also referred to as a scan signal line) to receive a scan signal Scan1, for example, a source electrode of the switching transistor T0 is connected to a data line to receive a data signal Vdata. and a drain electrode of the switching transistor T0 is connected to a gate electrode of the driving transistor N0; a source electrode of the driving transistor N0 is connected to a first voltage terminal to receive a first voltage Vdd (high voltage), and a drain electrode of the driving transistor N0 is connected to a positive terminal of an LED; one terminal of the storage capacitor Cs is connected to the drain electrode of the switching transistor T0 and the gate electrode of the driving transistor NO, and the other terminal of the storage capacitor Cs is connected to the source electrode of the driving transistor N0 and the first voltage terminal; a negative terminal of the LED is connected to a second voltage terminal to receive a second voltage Vss (low voltage, for example, ground voltage). A driving mode of the 2T1C pixel circuit is to control the brightness (grayscale) of a pixel via the two TFTs and the storage capacitor Cs. When the scan signal Scan1 is applied through the scan line to turn on the switching transistor T0, the data signal Vdata delivered by a data driving circuit through the data line will charge the storage capacitor Cs via the switching transistor T0, thereby storing the data signal Vdata in the storage capacitor Cs. And the stored data signal Vdata controls the conduction degree of the driving transistor N0, thereby controlling the amount of a current flowing through the driving transistor to drive the LED to emit light. And the amount of the current determines the grayscale of light emitted by the pixel. In the 2T1C pixel circuit shown in FIG. 1A, the switching transistor T0 is an N-type transistor and the driving transistor N0 is a p-type transistor.

As shown in FIG. 1B, another 2T1C pixel circuit also includes a switching transistor T0, a driving transistor N0, and a storage capacitor Cs, but connection manners thereof are slightly changed, and the driving transistor N0 is an N-type transistor. The variations of the pixel circuit in FIG. 1B with respect to the pixel circuit in FIG. 1A include that the positive terminal of the LED is connected to the first voltage terminal to receive the first voltage Vdd (high voltage), the negative terminal of the LED is connected to the drain electrode of the driving transistor N0, and the source electrode of the driving transistor N0 is connected to the second voltage terminal to receive the second voltage Vss (low voltage, e.g., ground voltage). One terminal of the storage capacitor Cs is connected to the drain electrode of the switching transistor T0 and the gate electrode of the driving transistor N0, and the other terminal of the storage capacitor Cs is connected to the source electrode of the driving transistor N0 and the second voltage terminal. The operation mode of the 2T1C pixel circuit is basically the same as that of the pixel circuit shown in FIG. 1A, and details will not be described here again.

In addition, for the pixel circuits shown in FIG. 1A and FIG. 1B, the switching transistor T0 is not limited to an N-type transistor, but can also be a p-type transistor, so that the polarity of the scan signal Scan1 that controls the switching transistor T0 to be turned on or off may be changed accordingly.

Due to the manufacturing process and material selection of Micro-LEDs themselves, the luminous efficiency of a red Micro-LED is usually low. Therefore, three, four or more Micro-LEDs need to be connected in series in a pixel circuit, so as to achieve a better luminous effect. However, for silicon-based Micro-LEDs (i.e., Micro-LEDs prepared on a silicon substrate), due to the limitation of the manufacturing process and techniques, a data range transferred to the pixel circuit is limited to a certain extent. The limited data range restricts a brightness regulation range of the silicon-based Micro-LEDs, thus restricting the application range of the silicon-based Micro-LEDs.

At least one embodiment of the present disclosure provides a pixel circuit, which includes a driving circuit, a data writing circuit, a storage circuit, and a grayscale regulation circuit. The driving circuit includes a control terminal, a first terminal and a second terminal, and is configured to control a driving current that drives a light emitting circuit to emit light, and the first terminal of the driving circuit is configured to receive a first voltage from a first voltage terminal; the data writing circuit is connected with the control terminal of the driving circuit and is configured to write a data signal into the control terminal of the driving circuit; the storage circuit is connected with the control terminal of the driving circuit and is configured to store the data signal written by the data writing circuit; the grayscale control circuit is connected with the second terminal of the driving circuit and a first terminal of the light emitting circuit, and is configured to regulate a voltage of the first terminal of the light emitting circuit according to the data signal in response to a switch driving signal.

At least one embodiment of the present disclosure further provides a driving method corresponding to the pixel circuit and a display panel corresponding to the pixel circuit.

The pixel circuit provided by the embodiment of the present disclosure can enable that the display brightness of the light emitting circuit when displaying a high grayscale is not affected or becomes higher, and the display brightness of the light emitting circuit when displaying a low grayscale can be lower, so that the brightness range of the light emitting circuit is expanded, the application scenarios of the pixel circuit are enlarged, and the contrast and the display effect of a display device based on the pixel circuit are improved.

The embodiments of the present disclosure will be described in detail below with reference to the accompanying drawings. It should be noted that the same reference numerals in different drawings will be used to refer to the same elements already described.

An example of at least one embodiment of the present disclosure provides a pixel circuit 10, which, for example, is applied to a sub-pixel of a Micro-LED display panel or a sub-pixel of an OLED display panel. In at least one embodiment of the present disclosure, the Micro-LED display panel is prepared, for example, based on a silicon substrate (e.g., a monocrystalline silicon substrate or a silicon-on-insulator substrate), and the OLED display panel is prepared, for example, based on a glass substrate. The specific structures and preparation processes can adopt conventional methods in the art, which will not be described in detail here, and the embodiments of the present disclosure are not limited thereto.

Figure 2:
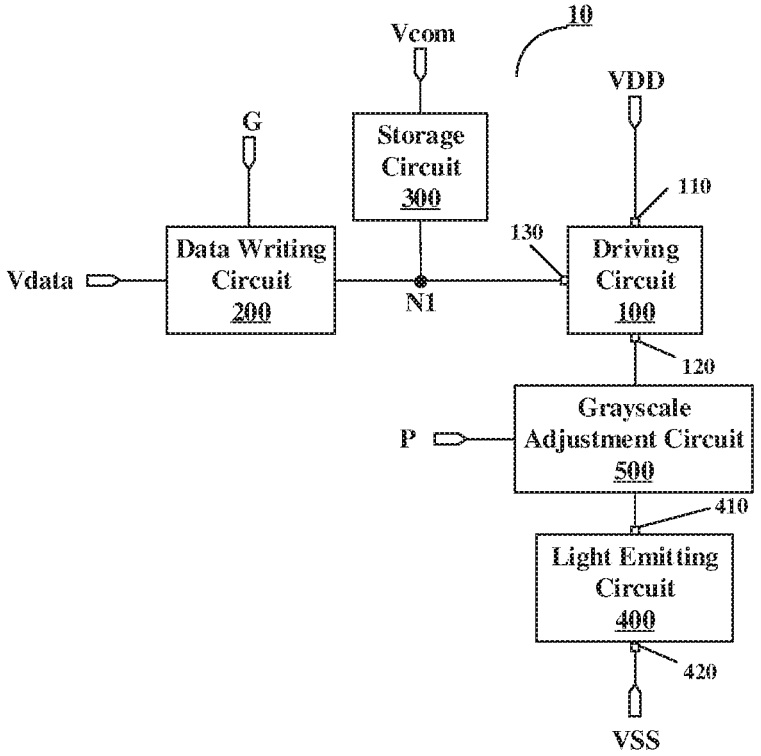
FIG. 2 is a schematic block diagram of a pixel circuit according to at least one embodiment of the present disclosure.

As shown in FIG. 2, the pixel circuit 10 includes a driving circuit 100, a data writing circuit 200, a storage circuit 300, and a grayscale regulation circuit 500.

For example, the driving circuit 100 includes a first terminal 110, a second terminal 120, and a control terminal 130, and is configured to control a driving current flowing through the first terminal 110 and the second terminal 120 and used for driving a light emitting circuit 400 to emit light, the control terminal 130 of the driving circuit 100 is connected to a first node N1, and the first terminal 110 of the driving circuit is configured to receive a first voltage from a first voltage terminal VDD. For example, in a light emitting stage, the driving circuit 100 can supply a driving current to the light emitting circuit 400 to drive the light emitting circuit 400 to emit light, and the light emitting circuit 400 can emit light according to a desired "grayscale". For example, the light emitting circuit 400 includes a plurality of light emitting elements connected in series. The light emitting elements may be Micro-LEDs or OLEDs, and are configured to be connected to the grayscale regulation circuit 500 and a second voltage terminal VSS (e.g., providing a low level, such as being grounded). The embodiments of the present disclosure include, but are not limited to, this case.

For example, the data writing circuit 200 is connected to the control terminal 130 (the first node N1) of the driving circuit 100 and is configured to write a data signal into the control terminal 130 of the driving circuit 100. For example, the data writing circuit 200 is connected to a data line (a data signal terminal Vdata), the first node N1, and a scan line (a scan signal terminal G), respectively. For example, the data writing circuit 200 can be turned on in response to a scanning signal supplied by the scanning signal terminal G, so that the data signal Vdata can be written into the control terminal 130 (the first node N1) of the driving circuit 100, and then the data signal Vdata can be stored in the storage circuit 300 to be described below, so as to generate a driving current for driving the light emitting circuit 400 to emit light according to the data signal Vdata. For example, the magnitude of the data signal Vdata determines the grayscale displayed by a pixel unit.

For example, the storage circuit 300 is connected to the control terminal 130 (the first node N1) of the driving circuit 100 and is configured to store the data signal Vdata written by the data writing circuit 200. For example, as shown in FIG. 2, the storage circuit 300 is further connected to a third voltage terminal Vcom to receive a third voltage, or in other examples, the storage circuit 300 can also be connected to the first terminal 110 (the first voltage terminal VDD) of the driving circuit 100, and the embodiments of the present disclosure are not limited thereto. For example, the storage circuit 300 can store the data signal Vdata and control the driving circuit 100 using the stored data signal Vdata. For example, in a case where the storage circuit 300 includes a storage capacitor, the storage circuit 300 can store the data signal Vdata written by the data writing circuit 200 in the storage capacitor, so that the driving circuit 100 can be controlled using a stored voltage including the data signal Vdata, for example, in the light emitting stage.

For example, the light emitting circuit 400 includes a first terminal 410 and a second terminal 420. The first terminal 410 of the light emitting circuit 400 is configured to receive a driving current from the second terminal 120 of the driving circuit 100. For example, as shown in FIG. 2, the first terminal 410 of the light emitting circuit 400 is connected to the second terminal 120 of the driving circuit 100 through the grayscale regulation circuit 500, so as to receive the driving current regulated by the grayscale regulation circuit 500. The second terminal 420 of the light emitting circuit 400 is configured to be connected to the second voltage terminal VSS.

For example, one terminal of the grayscale regulation circuit 500 is connected to the second terminal 120 of the driving circuit 100, another terminal of the grayscale regulation circuit 500 is connected to the first terminal 410 of the light emitting circuit 400, and the grayscale regulation circuit 500 is configured to regulate a voltage of the first terminal 410 of the light emitting circuit 400 according to the data signal in response to a switch driving signal, and apply the regulated voltage to the light emitting circuit 400 to control the light emitting elements in the light emitting circuit 400 to emit light with a corresponding brightness. For example, the grayscale regulation circuit 500 has a first cross voltage in a case where the light emitting circuit 400 displays a first grayscale (e.g., a low grayscale) and has a second cross voltage in a case where the light emitting circuit 400 displays a second grayscale (e.g., a high grayscale, that is, the first grayscale is less than the second grayscale), thereby controlling the driving current flowing through the light emitting circuit 400 according to the data signal and applying the driving current to the light emitting circuit 400. For example, in a case where the grayscale regulation circuit 500 is implemented as a transistor, the first cross voltage and the second cross voltage represent the voltage between the source electrode and the drain electrode of the transistor, and the first cross voltage is greater than the second cross voltage. For example, in a case where the light emitting circuit 400 displays a second grayscale (e.g., a high grayscale), the grayscale regulation circuit 500 can be used as a switching transistor, and the cross voltage between the source electrode and the drain electrode thereof is substantially zero, so that the display brightness of the light emitting circuit 400 is not affected or becomes higher when displaying a high grayscale; in a case where the light emitting circuit 400 displays a first grayscale (e.g., a low grayscale), the grayscale regulation circuit 500 can be used as a driving transistor, and the cross voltage between the source electrode and the drain electrode thereof is large, so that a divided voltage applied to both terminals of the light emitting circuit 400 is reduced, and the current flowing through the light emitting circuit 400 is reduced. And therefore, the brightness of the light emitting circuit 400 is lower when displaying a low grayscale, so that the brightness range of the light emitting circuit is expanded, and the application scenarios of the silicon-based Micro-LED are enlarged.

The pixel circuit provided by the embodiment of the present disclosure can enable that the display brightness of the light emitting circuit when displaying a high grayscale is not affected or becomes higher, and the display brightness of the light emitting circuit when displaying a low grayscale can be lower, so that the brightness range of the light emitting circuit is expanded, the application scenarios of the silicon-based Micro-LED are enlarged, and the contrast and the display effect of a display device based on the pixel circuit are improved.

Figure 3:
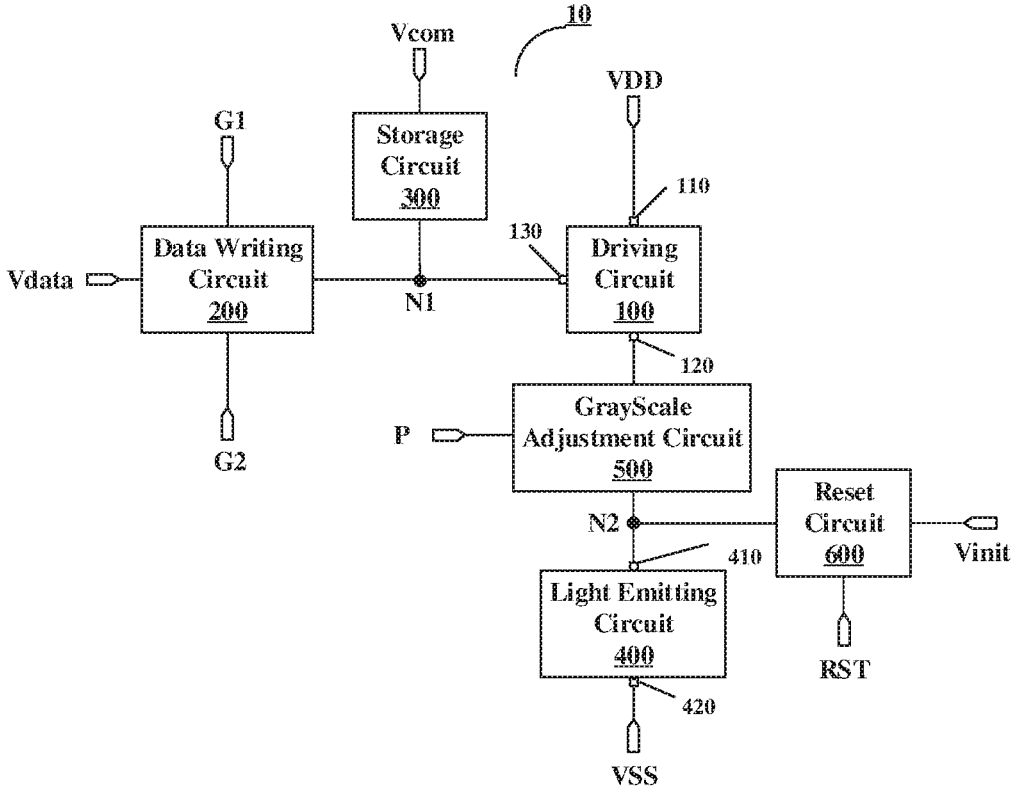
FIG. 3 is a schematic block diagram of another pixel circuit according to at least one embodiment of the present disclosure.

For example, as shown in FIG. 3, on the basis of the example shown in FIG. 2, the pixel circuit 10 further includes a reset circuit 600.

For example, in the present example, the scan signal line (the scan signal terminal G) includes a first scan signal line (a first scan signal terminal G1) and/or a second scan signal line (a second scan signal terminal G2), and a first scan signal from the first scan line (the first scan signal terminal G1) and/or a second scan signal from the second scan line (the second scan signal terminal G2) are applied to the data writing circuit 200 to control whether or not the data writing circuit 200 is turned on. For example, the data writing circuit 200 can be turned on in response to the first scan signal and/or the second scan signal, so that the data signal Vdata can be written into the control terminal 130 (the first node N1) of the driving circuit 100. In the embodiments of the present disclosure, the data writing circuit 200 can adopt mixed N-type and P-type transistors, and can include, for example, the first scan signal terminal G1 and the second scan signal terminal G2 simultaneously, thereby expanding a transmission range of data signals. It should be noted that the data writing circuit 200 may also include only an N-type transistor or a P-type transistor, so that the data writing circuit 200 may include only the first scan signal terminal G1 or only the second scan signal terminal G2, and the embodiments of the present disclosure are not limited thereto.

For example, the reset circuit 600 is connected to a reset voltage terminal Vinit and the first terminal 410 of the light emitting circuit 400, and is configured to apply a reset voltage to the first terminal 410 of the light emitting circuit 400 in response to, for example, a reset signal. For example, the reset signal is synchronized with the first scan signal. For example, as shown in FIG. 3, the reset circuit 600 is connected to the reset voltage terminal Vinit, the first terminal 410 (a second node N2) of the light emitting circuit 400, and a reset control terminal RST (a reset control line), respectively. For example, in an initialization stage, the reset circuit 600 can be turned on in response to a reset signal provided by the reset control terminal RST, so that a reset voltage can be applied to the first terminal 410 (the second node N2) of the light emitting circuit 400, and therefore, the light emitting circuit 400 can be reset to eliminate the influence of a previous light emitting stage (e.g., a previous frame of the display device).

For example, in a case where the driving circuit 100 is implemented as a driving transistor, a gate electrode of the driving transistor can serve as the control terminal 130 (connected to the first node N1) of the driving circuit 100, a first electrode (e.g., a source electrode) of the driving transistor can serve as the first terminal 110 of the driving circuit 100, and a second electrode (e.g., a drain electrode) of the driving transistor can serve as the second terminal 120 of the driving circuit 100.

It should be noted that, in the embodiments of the present disclosure, the first voltage terminal VDD, for example, keeps inputting a DC high level signal, and this DC high level is referred to as the first voltage; the second voltage terminal VSS, for example, keeps inputting a DC low level signal, and the DC low level is referred to as the second voltage which is lower than the first voltage; and the third voltage terminal Vcom, for example, keeps inputting a DC low level signal, and the DC low level signal is referred to as the third voltage. These cases are the same in the following embodiments and details will not be described again.

It should be noted that in the description of the embodiments of the present disclosure, the first node N1 and the second node N2 do not represent actual components, but rather represent junction points at which related circuits are connected in the circuit diagram.

It should be noted that in the description of the embodiment of the present disclosure, the symbol Vdata can represent both the data signal terminal and the level of the data signal. Similarly, the symbol Vinit can represent both the reset voltage terminal and the reset voltage, the symbol VDD can represent both the first voltage terminal and the first voltage, the symbol VSS can represent both the second voltage terminal and the second voltage, and Vcom can represent both the third voltage terminal and the third voltage. These cases are the same in the following embodiments and details will not be described again.

Figure 4:
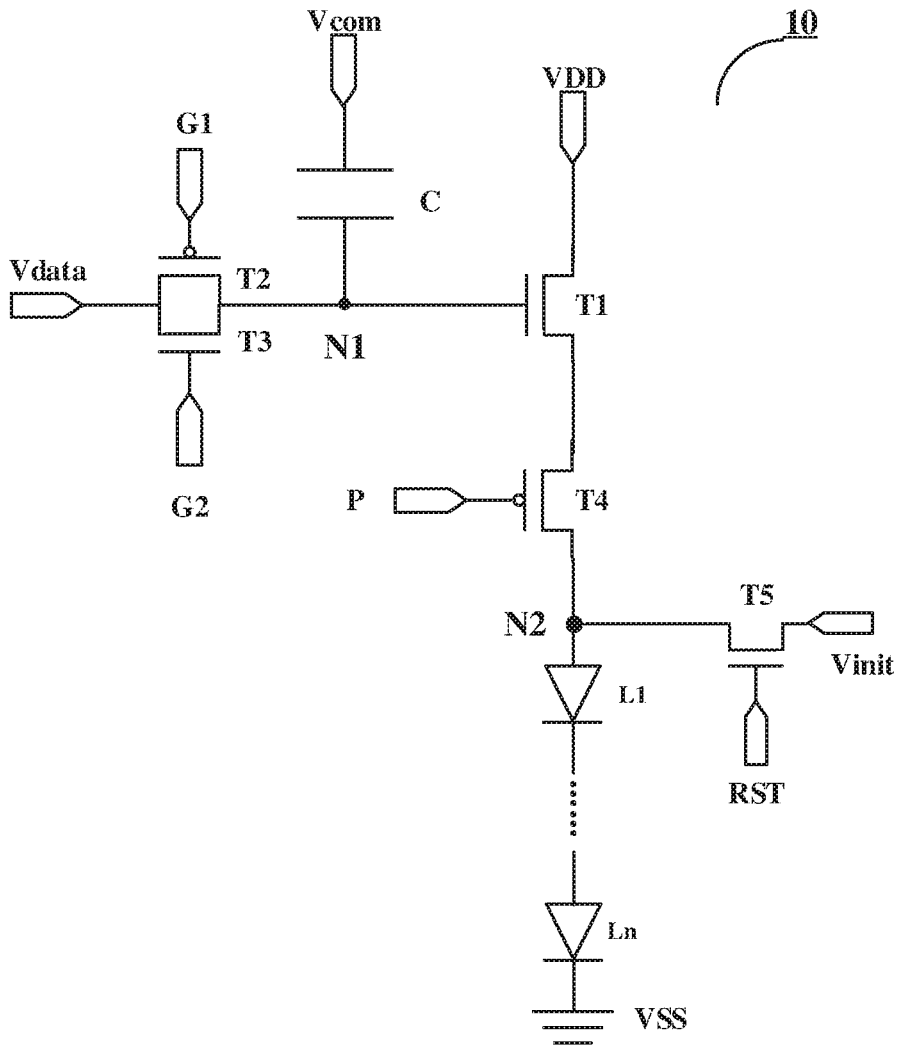
FIG. 4 is a circuit diagram of a specific implementation example of the pixel circuit shown in FIG. 3.

For example, the pixel circuit 10 shown in FIG. 3 can be specifically implemented as the pixel circuit structure shown in FIG. 4. As shown in FIG. 4, the pixel circuit 10 includes first to fifth transistors T1, T2, T3, T4, T5, a storage capacitor C and one or a plurality of light emitting elements L1, . . . , Ln (n is an integer greater than or equal to 1) connected in series. For example, the first transistor T1 is used as a driving transistor, the second, third, and fifth transistors are used as switching transistors, and the fourth transistor T4 is used as a driving transistor when the light emitting element displays a first grayscale (e.g., a low grayscale), and is used as a switching transistor when the light emitting element displays a second grayscale (e.g., a high grayscale). For example, the light emitting element LED can be of various types, such as top emission, bottom emission, double-sided emission, etc., and can emit red light, green light, blue light, etc. The embodiments of the present disclosure are not limited thereto.

For example, as shown in FIG. 4, more specifically, the driving circuit 100 can be implemented as the first transistor T1. A gate electrode of the first transistor T1 serves as the control terminal 130 of the driving circuit 100 and is connected to the first node N1; a first electrode of the first transistor T1 serves as the first terminal 110 of the driving circuit 100 and is connected to the first voltage terminal VDD; and a second electrode of the first transistor T1 serves as the second terminal 120 of the driving circuit 100 and is connected to the grayscale regulation circuit 500. For example, the first transistor T1 is an N-type transistor. For example, the N-type transistor is turned on in response to a high-level signal and turned off in response to a low-level signal. The following embodiments are the same as this and details will not be described again. It should be noted that the driving circuit 100 may also include a circuit formed by other elements without being limited thereto.

The data writing circuit 200 can be implemented as the second transistor T2 or the third transistor T3, or both the second transistor T2 and the third transistor T3. A gate electrode of the second transistor T2 is connected to the first scan line (the first scan signal terminal G1) to receive the first scan signal, a first electrode of the second transistor T2 is connected to the data line (the data signal terminal Vdata) to receive the data signal, and a second electrode of the second transistor T2 is connected to the control terminal 130 (i.e., the first node N1) of the driving circuit 100. A gate electrode of the third transistor T3 is connected to the second scan line (the second scanning signal terminal G2) to receive the second scan signal, a first electrode of the third transistor T3 is connected to the data line (the data signal terminal Vdata) to receive the data signal, and a second electrode of the third transistor T3 is connected to the control terminal 130 (i.e., the first node N1) of the driving circuit 100. For example, the second transistor T2 is a P-type transistor, such as a thin film transistor with an active layer of low-temperature doped polysilicon; the third transistor T3 is an N-type transistor, such as a thin film transistor with an active layer of low-temperature doped polysilicon, or a thin film transistor with an active layer of hydrogenated amorphous silicon or indium gallium zinc oxide (IGZO), etc. The use of IGZO as the active layer helps to reduce the size of the driving transistor and prevent leakage current. The following embodiments are the same as the above and details will not be described again. For example, the P-type transistor is turned on in response to a low-level signal and turned off in response to a high-level signal. The following embodiments are the same as the above and details will not be described again. In the embodiments of the present disclosure, the data writing circuit 200 can adopt mixed N-type and P-type transistors, and can include, for example, the second transistor T2 and the third transistor T3 at the same time, thereby expanding the transmission range of data signals. The following description will take this case as an example, but the embodiments of the present disclosure is not limited to this case. It should be noted that the data writing circuit 200 may also include only the second transistor T2 or only the third transistor T3, and the embodiments of the present disclosure are not limited thereto. It should be noted that the data writing circuit 200 can also include a circuit formed by other elements without being limited thereto.

The storage circuit 300 can be implemented as the storage capacitor C. A first electrode of the storage capacitor C is connected to the control terminal 130 (i.e., the first node N1) of the driving circuit 100, and a second electrode of the storage capacitor C is connected to the third voltage terminal Vcom to receive the third voltage. It should be noted that the second electrode of the storage capacitor C can also be connected to the first electrode (the first voltage terminal VDD) of the first transistor T1, and the embodiments of the present disclosure is not limited thereto. It should also be noted that the storage circuit 300 is not limited to this case, and can also include a circuit formed by other elements to realize the corresponding function.

The first terminal 410 (here, an anode) of the light emitting circuit 400 is connected to the second node N2 and is configured to receive a driving current from the second terminal 120 of the driving circuit 100 via the grayscale regulation circuit 500, and the second terminal 420 (here, a cathode) of the light emitting circuit 400 is configured to be connected to the second voltage terminal VSS to receive the second voltage. For example, the second voltage terminal can be grounded, that is, VSS can be 0V. For example, the light emitting circuit 400 includes one or a plurality of red light emitting elements L1-Ln connected in series to solve the problem of low light emitting efficiency of the red Micro-LEDs. The embodiments of the present disclosure will be described by taking four light emitting elements connected in series as an example, but the embodiments of the present disclosure are not limited thereto. The following embodiments are the same as this and details will not be described again.

The grayscale regulation circuit 500 can be implemented as the fourth transistor T4. A gate electrode of the fourth transistor T4 is connected to a switch driving signal line (a switch driving signal terminal P) to receive the switch driving signal, a first electrode of the fourth transistor T4 is connected to the second terminal 120 of the driving circuit 100, and a second electrode of the fourth transistor T4 is connected to the first terminal 410 (i.e., the second node N2) of the light emitting circuit 400. For example, the fourth transistor T4 is a P-type transistor. It should be noted that, the grayscale regulation circuit 500 can also include a circuit formed by other elements without being limited thereto.

The reset circuit 600 can be implemented as the fifth transistor T5. A gate electrode of the fifth transistor T5 is connected to the reset control line (the reset control terminal RST) to receive the reset signal, a first electrode of the fifth transistor T5 is connected to the reset voltage terminal Vinit to receive the reset voltage, and a second electrode of the fifth transistor T5 is connected to the first terminal 410 of the light emitting circuit 400. For example, the fifth transistor T5 is an N-type transistor. It should be noted that the reset circuit 600 can also include a circuit formed by other elements without being limited thereto.

Figure 5:
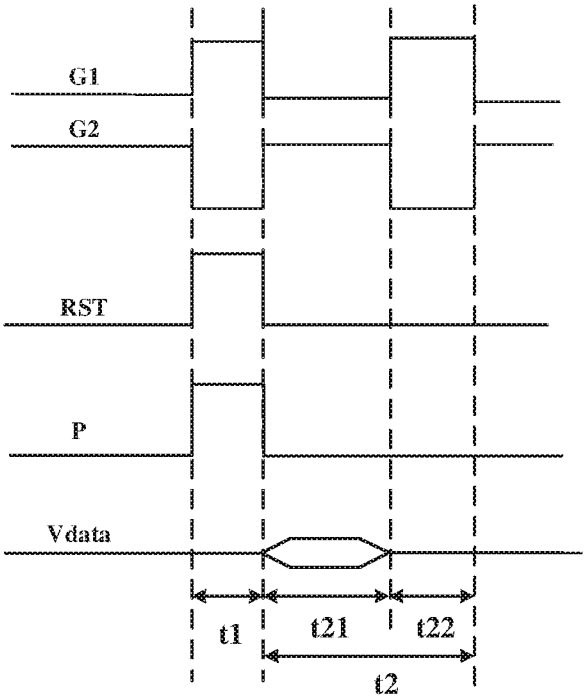
FIG. 5 is a timing diagram of a driving method of a pixel circuit according to at least one embodiment of the present disclosure.

FIG. 5 is a signal timing diagram of a pixel circuit according to at least one embodiment of the present disclosure. The operation principle of the pixel circuit 10 shown in FIG. 4 will be described below with reference to the signal timing chart shown in FIG. 5.

As shown in FIG. 5, a display process of each frame of image includes two stages, namely an initialization stage t1 and a light emitting stage t2. For example, the light emitting stage t2 includes a data writing sub-stage t21 and a stable light emitting sub-stage t22. The timing waveform of each signal in each stage is shown in FIG. 5.

Figure 6:
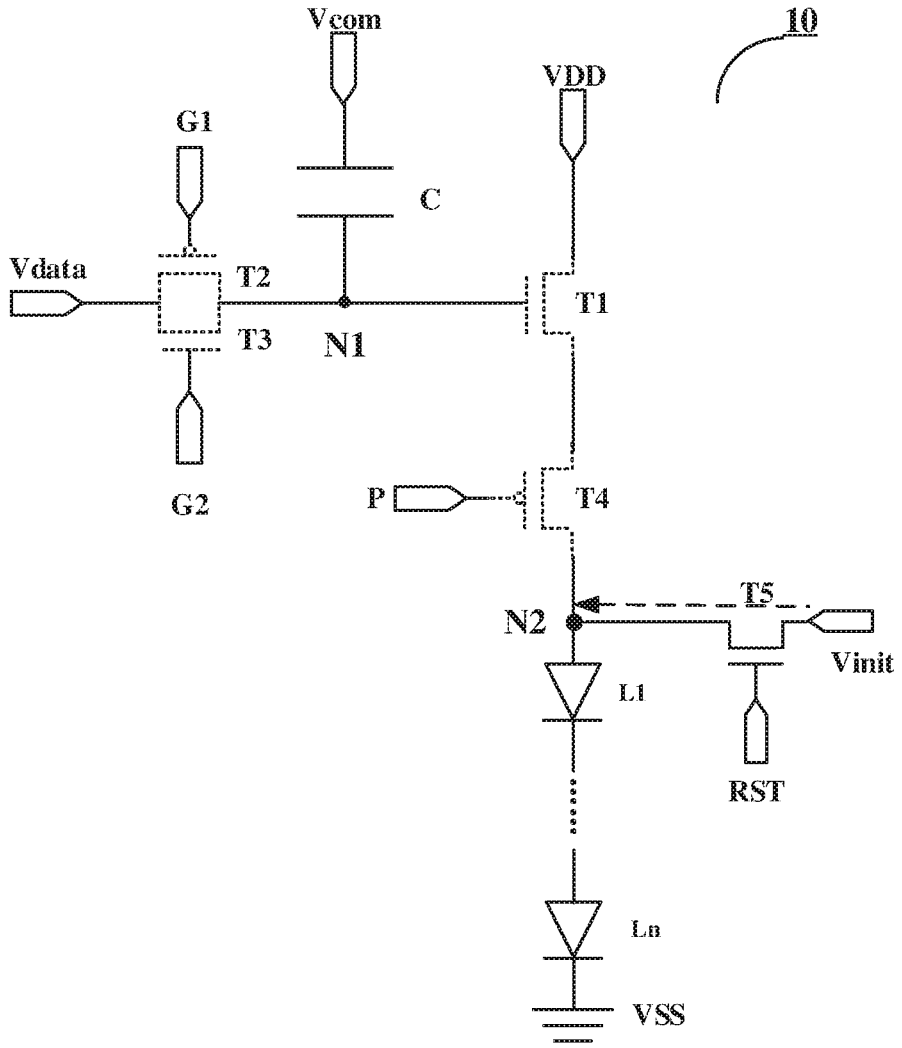
FIG. 6 to FIG. 8 are schematic circuit diagrams of the pixel circuit shown in FIG. 4 corresponding to two stages shown in FIG. 5, respectively.
Figure 7:
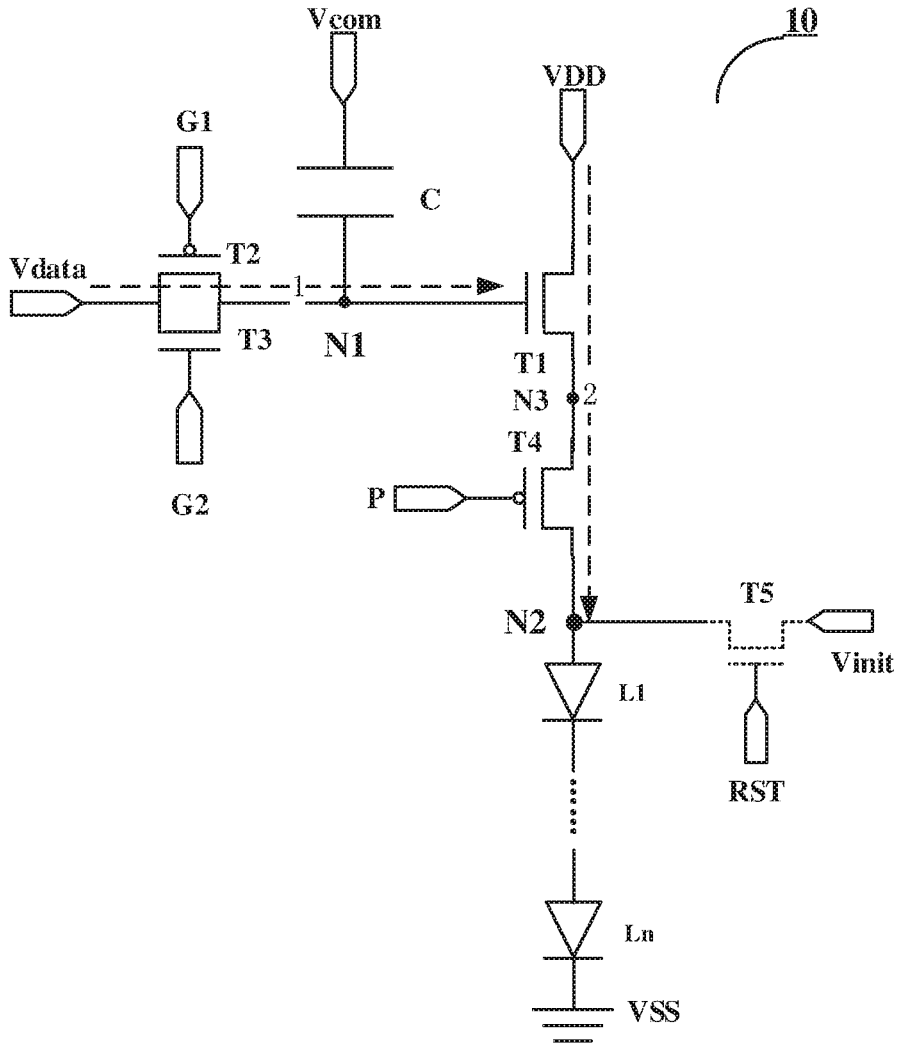
Figure 8:
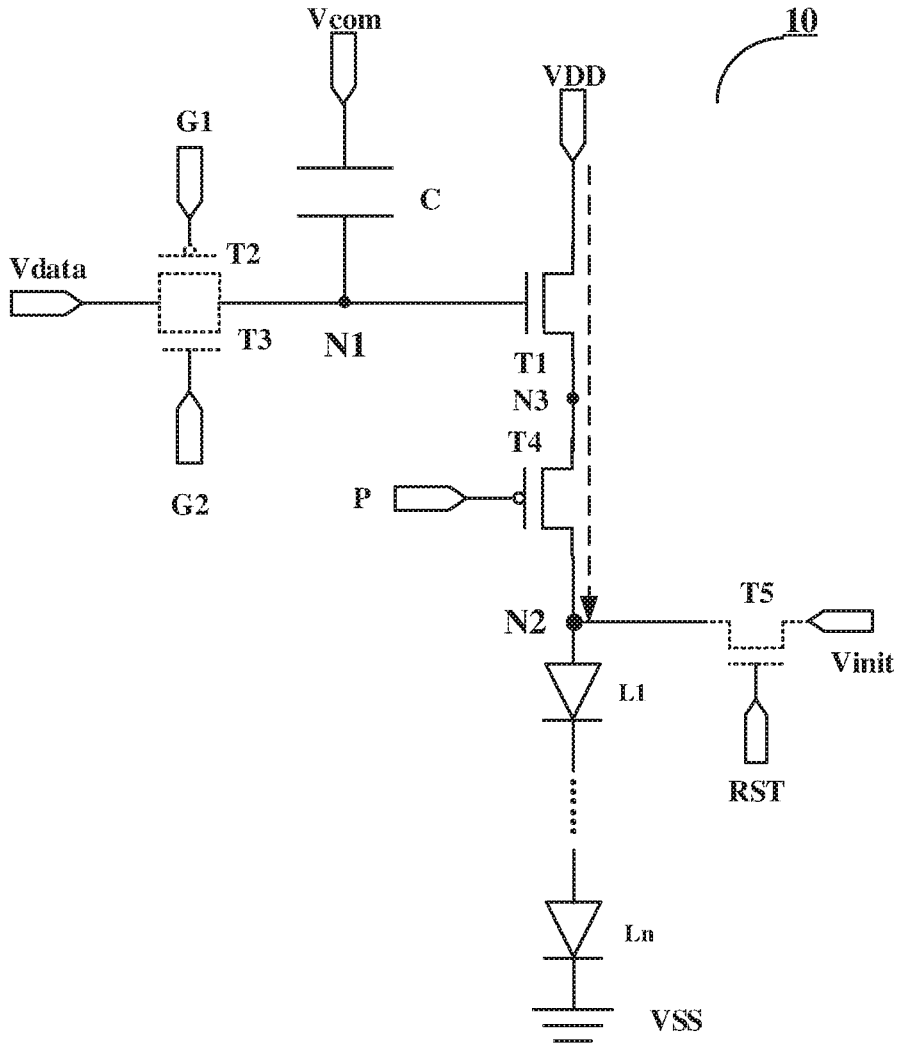

It should be noted that FIG. 6 is a schematic diagram when the pixel circuit shown in FIG. 4 is in the initialization stage t1, FIG. 7 is a schematic diagram when the pixel circuit shown in FIG. 4 is in the data writing sub-stage t21 of the light emitting stage t2, and FIG. 8 is a schematic diagram when the pixel circuit shown in FIG. 4 is in the stable light emitting sub-stage t22 of the light emitting stage t2. In addition, the transistors identified by dashed lines in FIG. 6 to FIG. 8 all indicate that they are in an off state in the corresponding stages, and the dashed lines with arrows in FIG. 6 to FIG. 8 indicate current directions of the pixel circuit in the corresponding stages. The transistors shown in FIG. 6 to FIG. 8 are all illustrated by taking the second transistor T2 and the fourth transistor T4 are P-type transistors and the other transistors are N-type transistors as an example. Each N-type transistor is turned on in a case where the gate electrode thereof receives a high level, and is turned off in a case where the gate electrode thereof receives a low level; each P-type transistor is turned on in a case where the gate electrode thereof receives a low level, and is turned off in a case where the gate electrode thereof receives a high level. The following embodiments are the same as this and details will not be described again.

In the initialization stage t1, a reset signal is inputted to turn on the reset circuit 600, and a reset voltage is applied to the first terminal 410 of the light emitting circuit 400.

As shown in FIG. 5 and FIG. 6, in the initialization stage t1, because the fifth transistor T5 is an N-type transistor, the fifth transistor T5 is turned on by the high level of the reset signal; meanwhile, the second transistor T2 is turned off by the high level of the first scan signal, the third transistor T3 is turned off by the low level of the second scan signal, and the fourth transistor T4 is turned off by the high level of the switch driving signal.

As shown in FIG. 6, in the initialization stage t1, a reset path (as shown by the dashed line with an arrow in FIG. 6) is formed. Therefore, in this stage, the light emitting elements L1-Ln in the light emitting circuit 400 are discharged via the fifth transistor T5, thereby resetting the first terminal 410 (the second node N2) of the light emitting circuit 400. Therefore, the potential of the second node N2 after the initialization stage t1 is the reset voltage Vinit (a low-level signal, for example, may be grounded or other low-level signals).

After the initialization stage t1, the first terminal 410 (the second node N2) of the light emitting circuit 400 is reset, so that the light emitting elements L1-Ln can be in a black state without emitting light before the light emitting stage t2, thereby improving the contrast of the display device using the pixel circuit and improving the display effect.

In the data writing sub-stage t21 of the light emitting stage T2, a first scan signal, a second scan signal and a data signal are inputted to turn on the data writing circuit 200 and the driving circuit 100, the data writing circuit 200 writes the data signal into the driving circuit 100, and the storage circuit 300 stores the data signal; a switch driving signal is inputted to turn on the grayscale regulation circuit 500, so that the grayscale regulation circuit 500 has a first cross voltage in a case where the light emitting circuit 400 displays a first grayscale (e.g., low grayscale) and has a second cross voltage in a case where the light emitting circuit 400 displays a second grayscale (e.g., high grayscale, that is, the first grayscale is less than the second grayscale), thereby controlling the driving current flowing through the light emitting circuit 400 according to the data signal and applying the driving current to the light emitting circuit 400. For example, the first cross voltage is greater than the second cross voltage.

As shown in FIG. 5 and FIG. 7, in the data writing sub-stage t21, the second transistor 12 is turned on by the low level of the first scan signal, the third transistor T3 is turned on by the high level of the second scan signal, and the fourth transistor T4 is turned on by the low level of the switch driving signal; meanwhile, the fifth transistor T5 is turned off by the low level of the reset signal.

As shown in FIG. 7, in the data writing sub-phase t21, a data writing path (as shown by dashed line 1 with an arrow in FIG. 7) is formed. The data signal charges the storage capacitor C via the second transistor T2 and/or the third transistor T3, thereby writing the data signal Vdata into the storage capacitor C. and at the same time, the potential of the first node N1 becomes the level of the data signal Vdata. As shown in FIG. 7, the range of the level of the data signal Vdata can fluctuate up and down, so as to control the conduction degree of the first transistor T1 (the driving transistor) according to the variation of the level of the data signal Vdata, thereby controlling the magnitude of the current flowing through the first transistor T1. For example, the fluctuation range of the level of the data signal Vdata can meet the requirement of turning on the first transistor T1. For example, the data signal Vdata=[11, 17]V, that is, the level of the data signal Vdata fluctuates between 11V and 17V, and the data signal Vdata can be obtained by gamma conversion of a digital signal using a controller (e.g., a timing controller). For example, in a case where the data signal has a value between 11V and 12V, the light emitting circuit 400 displays a low grayscale, and in a case where the data signal has a value between 12V and 17V (including 12V), the light emitting circuit 400 displays a high grayscale. It should be noted that a corresponding relationship between the magnitude of the data signal and the magnitude of grayscale displayed by the light emitting circuit depends on a specific situation, and the embodiment of the present disclosure is not limited thereto.

In a case where a voltage difference between the first node N1 and the second terminal 120 of the driving circuit 100 is greater than a threshold voltage Vth1 of the first transistor T1, the first transistor T1 is turned on, and a driving current is applied to the first terminal 410 of the light emitting circuit 400 through the grayscale regulation circuit 500, thereby driving the light emitting elements L1-Ln to emit light. It should be noted that Vth1 represents the threshold voltage of the first transistor T1. In the present embodiment, the first transistor T1 is illustrated as an N-type transistor, so the threshold voltage Vth1 can be a positive value here. In other embodiments, if the first transistor T1 is a P-type transistor, the threshold voltage Vth1 may be a negative value.

As shown in FIG. 7, in this stage, a driving light emitting path (as shown by dashed line 2 with an arrow in FIG. 7) is formed at the same time. Because the first transistor T1 and the fourth transistor T4 are turned on, the driving current can be supplied to the light emitting circuit 400 via the first transistor T1 and the fourth transistor T4, and the light emitting circuit 400 can emit light under the action of the driving current. For example, the fourth transistor T4 operates in a saturation region when the light emitting circuit 400 displays a first grayscale (e.g., a low grayscale), and operates in a linear region when the light emitting circuit 400 displays a second grayscale (e.g., a high grayscale).

As shown in FIG. 7, in the data writing stage t21, the first transistor T1 is an N-type transistor and has a source follower architecture, so the voltage of the second terminal 120 (i.e., the third node N3) of the driving circuit 100 can be expressed as $V_{N3}=V_{N1}-Vth1$, where Vth1 represents the threshold voltage of the first transistor T1, e.g., Vth1=1V, which will be described as an example below. However, those skilled in the art can know that the threshold voltage of the first transistor T1 can be adjusted according to its manufacturing process, material, etc., and thus is not limited to this specific value. For example, if the voltage of the first node N1 (i.e., the data signal Vdata) is $V_{N1}$=[11, 17]V, the voltage N3 of the third node N3 is $V_{N3}$=[10,16]V. If the fourth transistor T4 always operates in a linear region, that is, the voltage of the switch driving signal provided by the switch driving terminal P (i.e., the gate voltage of the fourth transistor) is set to an ultra-low voltage, for example, lower than 9V, then the fourth transistor T4 is in a fully on state, and a cross voltage thereof can be as low as 0.1V, which is negligible. In this case, the voltage of the first terminal 410 (the second node N2) of the light emitting circuit 400 is $V_{N2}\approx$[10,16]V.

For example, a full grayscale range of each light emitting element Micro-LED is 2-4V, for example, the light emitting circuit 400 has a full grayscale range of 8-16V in a case where it includes four light emitting elements Micro-LED connected in series. In the above case (the case where the grayscale regulation circuit 500 is not added), when the light emitting circuit 400 displays the brightness of the lowest grayscale, an anode voltage (the voltage of the first terminal 410) thereof can only reach 10V. and cannot be reduced to 8V. Therefore, in this case, the brightness of the light emitting circuit 400 will not reach the lowest brightness that it can theoretically realize. For example, in order to make the brightness of the light emitting circuit 400 lowest when displaying a low grayscale, the voltage of the first node N1 is set to $V_{N1}$=[9, 15]V, then the voltage of the third node N3 is $V_{N3}$=[8, 14]V, which can reach the grayscale voltage 8V of the lowest display brightness. However, in this case (the case where the grayscale regulation circuit 500 is not added), when the light emitting circuit 400 displays a high grayscale, the anode voltage (the voltage of the first terminal 410) can only reach a voltage of 14V and cannot be increased to 16V. Therefore, the maximum brightness of the light emitting circuit 400 when displaying a high grayscale is limited and cannot reach the maximum brightness theoretically achievable. From the above analysis, it can be seen that this limited voltage programming makes the cross voltage range of the light emitting element Micro-LED driven only by the first transistor T1 limited, and thus the display brightness range thereof is also limited.

In the embodiment of the present disclosure, the grayscale regulation circuit 500 is added to assist the driving circuit to realize a driving control of the light emitting element. The grayscale regulation circuit 500 is implemented, for example, as a fourth transistor T4, which is a P-type transistor. For a P-type transistor, its operating states include the following three states, wherein Vth2 is the threshold voltage of the P-type transistor, which is usually negative, so the following expression takes the form of absolute value, Vgs is the gate-source voltage (a difference between gate voltage and source voltage) of the P-type transistor, and Vds is the drain-source voltage (a difference between drain voltage and source voltage) of the P-type transistor.

(1) In a case where $|Vgs|<|Vth2|$, the P-type transistor is in a cut-off region;

(2) in a case where $|Vds|<|Vgs|-|Vth2|$, the p-type transistor is in a linear region, in this case, the P-type transistor is equivalent to a resistor with a small resistance, and at the same time, for a given gate voltage, the current Ids flowing through the drain and the source is proportional to the drain-source voltage Vds;

(3) in a case where $|Vds|>|Vgs|-|Vth2|$, the P-type transistor is in a saturation region, in this case, the current Ids flowing through the drain and the source is not related to the drain-source voltage Vds but to the gate-source voltage Vgs, and $Ids=K(Vgs-Vth2)^2$.

Thus, for the fourth transistor T4, when the value or range of the gate voltage is given, the voltage applied to the gate of the fourth transistor T4 can be selected to make the fourth transistor T4 in a desired state, and then the magnitude of its cross voltage (i.e., the magnitude of Vds) can be regulated.

For example, in one example of the embodiment of the present disclosure, the voltage of the switch driving signal provided by the switch driving terminal P is set to a voltage that enables the fourth transistor T4 to be in a linear region when displaying a high grayscale and to be in a saturation region when displaying a low grayscale, thereby controlling the magnitude of the driving current flowing through the light emitting circuit 400. For example, the voltage of the switch driving signal provided by the switch driving signal terminal P is set to 9V, that is, the gate voltage of the fourth transistor T4 is set to 9V, while the threshold voltage Vth2 of the fourth transistor T4 is set to −1V. The following will be described by taking this case as an example, however, those skilled in the art can know that the threshold voltage Vth2 of the fourth transistor T4 can be adjusted according to its manufacturing process, material, etc., and thus is not limited to this specific value. For example, the data voltage applied to the first node N1 is $V_{N}i$=[11, 17]V, then the voltage of the third node N3 is $V_{N3}$=[10, 16]V, correspondingly.

When the light emitting circuit 400 displays a high grayscale, for example, when the voltage of the first node N1 is $V_{N1}$=[12,17]V and the voltage of the third node N3 is $V_{N3}$=[11,16]V, the voltage Vgs between the gate (i.e., the switch driving signal terminal P) and the source (i.e., the third node N3) of the fourth transistor T4 is Vgs=[−2,7]V, so that the fourth transistor T4 is in a linear region, and the cross voltage of the fourth transistor T4 is 0.1 V or less. At this time, the fourth transistor T4 is used as a switching transistor, therefore, the voltage at the first terminal 410 of the light emitting circuit 400 is basically the same as the voltage at the third node N3, i.e., the voltage of the second node N2 is $V_{N2}$≈[11,16]V. It can be seen from this that when the light emitting circuit 400 displays a high grayscale, the voltage at the first terminal 410 of the light emitting circuit 400 can reach the voltage required for the highest brightness, for example, 16V.

When the light emitting circuit 400 displays a low grayscale, for example, when the voltage of the first node N1 is $V_{N1}$=[11,12]V and the voltage of the third node N3 is $V_{N3}$=[10,11V, the voltage Vgs between the gate (i.e., the switch driving signal terminal P) and the source (i.e., the third node N3) of the fourth transistor T4 is Vgs=[−1,−2]V, so that the fourth transistor T4 is in a saturation region with a large drain-source voltage. As a result, a divided voltage of the light emitting circuit 400 is reduced. At this time, the current flowing through the fourth transistor T4 is small. For example, the current flowing through the fourth transistor T4 is the current between the drain (the third node N3) and the source (the second node N2) of the fourth transistor T4, which can be expressed as:

$$Ids=K(Vgs-Vth2)^2$$

where K=W*Cox*U/L.

In the above formula, Vth2 represents the threshold voltage of the fourth transistor T4. Vgs represents the gate-source voltage of the fourth transistor T4, and K is a constant value related to the fourth transistor itself.

For example, when the light emitting circuit 400 displays a low grayscale, the fourth transistor T4 is used as a driving transistor. The current flowing through the light emitting circuit 400 no longer depends only on the turn-on degree of the first transistor T1, but also depends on the turn-on degree of the fourth transistor T4. Moreover, because the gate-source voltage Vgs of the fourth transistor T4 is small (compared with that of the first transistor T1), the driving current flowing through the light emitting circuit 400 can be small, thereby reducing the brightness of the light emitting circuit 400 when displaying a low grayscale. It can also be understood in this way that when the light emitting circuit 400 displays a low grayscale, the cross voltage of the fourth transistor T4 can be up to 1V or more, thereby reducing the voltage at the first terminal 410 (the second node N2) of the light emitting circuit 400, and reducing the divided voltage of both terminals of the light emitting circuit 400. And therefore, the brightness of the light emitting circuit 400 is reduced when displaying a low grayscale, thereby expanding the range of display brightness of the light emitting circuit.

In the stable light emitting sub-stage t22 of the light emitting stage T2, a switch driving signal is inputted to turn on the grayscale regulation circuit 500, so that the grayscale regulation circuit 500 has a first cross voltage in a case where the light emitting circuit 400 displays a first grayscale (e.g., low grayscale) and has a second cross voltage in a case where the light emitting circuit 400 displays a second grayscale (e.g., high grayscale, the first grayscale is less than the second grayscale), thereby controlling the driving current flowing through the light emitting circuit 400 according to the data signal and applying the driving current to the light emitting circuit 400. For example, the first cross voltage is greater than the second cross voltage.

As shown in FIG. 5 and FIG. 8, in the stable light emitting sub-stage t22, the fourth transistor T4 is turned on by the low level of the switch driving signal; meanwhile, the second transistor T2 is turned off by the high level of the first scan signal, the third transistor T3 is turned off by the low level of the second scan signal, and the fifth transistor T5 is turned off by the low level of the reset signal.

As shown in FIG. 8, at this stage, a driving light emitting path (as shown by the dashed line with an arrow in FIG. 8) is formed. The working principle thereof is similar to that of the driving light emitting in the data writing sub-stage t21, and details will not be described here.

It should be noted that the transistors used in the embodiments of the present disclosure can be thin film transistors or field effect transistors or other switching elements with the same characteristics, and the embodiments of the present disclosure are all described with thin film transistors as examples. The source and drain of the transistor used here can be symmetrical in structure, so the source and drain can be structurally indistinguishable. In the embodiments of the present disclosure, in order to distinguish the two electrodes of a transistor except the gate, one electrode is directly described as the first electrode and the other electrode is described as the second electrode.

In addition, it should be noted that the transistors in the pixel circuit 10 shown in FIG. 4 are illustrated by taking the second transistor T2 and the fourth transistor T4 as P-type transistors and other transistors as N-type transistors. In this case, the first electrode may be a drain electrode and the second electrode may be a source electrode. As shown in FIG. 2 and FIG. 3, the second terminal 420 of the light emitting circuit 400 is connected to the second voltage terminal VSS in the pixel circuit 10 to receive a second voltage. For example, in a display panel, in a case where the pixel circuits 10 shown in FIG. 4 are arranged in an array, the cathodes of the light emitting elements Ln (the second terminals 420 of the light emitting circuits 400) can be electrically connected to a same voltage terminal, that is, a common cathode connection mode is adopted.

At least one embodiment of the present disclosure further provides a display panel including a plurality of pixel units arranged in an array, and each of the plurality of pixel units includes the pixel circuit and the light emitting circuit provided by any embodiment of the present disclosure.

Figure 9:
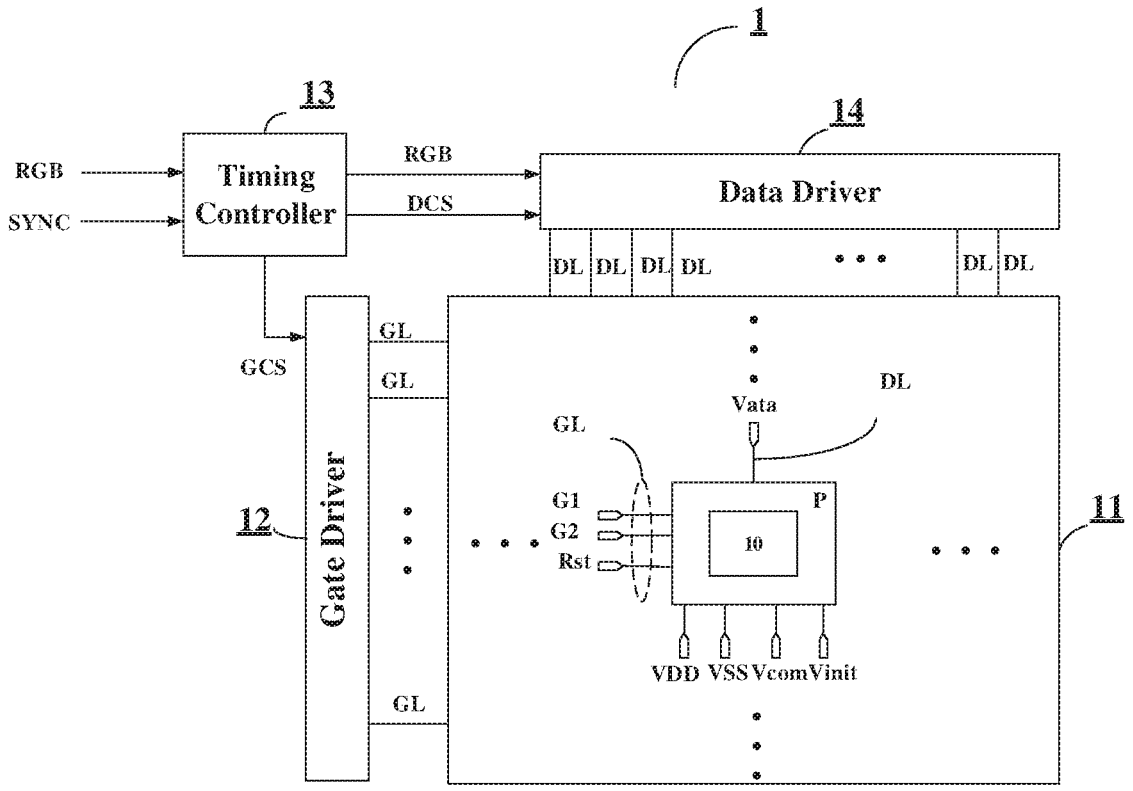
FIG. 9 is a schematic diagram of a display panel according to at least one embodiment of the present disclosure.

FIG. 9 is a schematic block diagram of a display panel provided by at least one embodiment of the present disclosure. As shown in FIG. 9, the display panel 11 is provided in a display device 1, and is electrically connected to a gate driver 12, a timing controller 13, and a data driver 14. The display panel 11 includes a pixel unit P defined by crossing a plurality of scan lines GL and a plurality of data lines DL; the gate driver 12 is configured to drive the plurality of scan lines GL; the data driver 14 is configured to drive the plurality of data lines DL; the timing controller 13 is configured to process image data RGB inputted from the external of the display device 1, supply the processed image data RGB to the data driver 14, and output a scan control signal GCS to the gate driver 12 and a data control signal DCS to the data driver 14, so as to control the gate driver 12 and the data driver 14.

For example, the display panel 11 includes a plurality of pixel units P, and each pixel unit P includes any one of the pixel circuits 10 and any one of the light emitting circuits 400 provided by the above embodiments. For example, each pixel unit P includes the pixel circuit 10 shown in FIG. 4. As shown in FIG. 9, the display panel 11 further includes a plurality of scan lines GL and a plurality of data lines DL. For example, the plurality of scan lines are correspondingly connected to the data writing circuits 200 of the pixel circuits 10 in each row of pixel units to provide a first scan signal and a second scan signal, and the plurality of scan lines are also correspondingly connected to the reset circuits 600 of the pixel circuits 10 in each row of pixel units to provide a reset signal. For example, the reset signal is synchronized with the first scan signal, and the reset signal of the pixel circuits of a current row can also be provided by the first scan line of the pixel circuits of a next row in a scanning process, thereby simplifying the layout space around the display panel and realizing the development of the high-resolution display panel.

For example, the pixel unit P is disposed in an intersection region of the scan lines GL and the data lines DL. For example, as shown in FIG. 9, each pixel unit P is connected to three scan lines GL (respectively providing a first scan signal, a second scan signal, and a reset signal), one data line DL, a first voltage line for providing a first voltage, a second voltage line for providing a second voltage, a third voltage line for providing a third voltage, and a reset voltage line for providing a reset voltage. For example, the first voltage line or the second voltage line can be replaced with a corresponding common electrode (e.g., a common anode or a common cathode). It should be noted that only part of the pixel units P, scan lines GL, and data lines DL are shown in FIG. 9. It should be noted that the following examples are the same as this case and details will not be described again.

For example, the plurality of pixel units P are arranged in a plurality of rows, the reset circuits 600 of the pixel circuits in each row of pixel units P are connected to a same scan line GL, and the data writing circuits 200 of the pixel circuits in each row of pixel units P are connected to the other two scan lines GL to receive the first scan signal and the second scan signal. For example, the data line DL of each column is connected to the data writing circuits 200 of the pixel circuits 10 in this column to provide a data signal.

For example, the gate driver 12 supplies a plurality of gate signals to a plurality of scan lines GL according to a plurality of scan control signals GCS originating from the timing controller 13. The plurality of gate signals include a first scan signal, a second scan signal, and a reset signal. These signals are supplied to each pixel unit P through a plurality of scan lines GL.

For example, the data driver 14 converts digital image data RGB inputted from the timing controller 13 into data signals according to a plurality of data control signals DCS originating from the timing controller 13 by using a reference gamma voltage. The data driver 14 supplies the converted data signals to the plurality of data lines DL.

For example, the timing controller 13 processes image data RGB inputted from the external to match the size and resolution of the display panel 11, and then supplies the processed image data to the data driver 14. The timing controller 13 generates a plurality of scan control signals GCS and a plurality of data control signals DCS using synchronization signals (e.g., a dot clock signal DCLK, a data enable signal DE, a horizontal synchronization signal Hsync, and a vertical synchronization signal Vsync) inputted from the external of the display device. The timing controller 13 supplies the generated scan control signal GCS and data control signal DCS to the gate driver 12 and the data driver 14, respectively, for control of the gate driver 12 and the data driver 14.

For example, the data driver 14 can be connected to a plurality of data lines DL to provide a data signal Vdata; at the same time, the data driver 14 can also be connected with a plurality of first voltage lines, a plurality of second voltage lines, a plurality of third voltage lines and a plurality of reset voltage lines to provide a first voltage, a second voltage, a third voltage and a reset voltage, respectively.

For example, the gate driver 12 and the data driver 14 can be implemented as semiconductor chips. The display device 1 can also include other components, such as a signal decoding circuit, a voltage conversion circuit, etc. These components can, for example, adopt conventional components, which will not be described in detail here.

For example, the display panel 11 provided by the present embodiment can be applied to any product or component having a display function, such as an electronic paper, a mobile phone, a tablet computer, a television, a display, a notebook computer, a digital photo frame, a navigator, a virtual reality display device, etc.

The technical effects of the display panel 11 can be referred to the technical effects of the pixel circuit 10 provided by the embodiments of the present disclosure, and details will not be repeated here.

At least one embodiment of the present disclosure further provides a driving method that can be used to drive the pixel circuit 10 provided by the embodiments of the present disclosure. For example, for the example of the pixel circuit shown in FIG. 2, the driving method includes the following operations:

in the light-emitting stage, inputting a switch driving signal to turn on the grayscale regulation circuit 500, so that the grayscale regulation circuit 500 has a first cross voltage in a case where the light-emitting circuit 400 displays a first grayscale and has a second cross voltage in a case where the light-emitting circuit 400 displays a second grayscale, thereby controlling the driving current flowing through the light-emitting circuit 400 according to the data signal and applying the driving current to the light-emitting circuit 400.

For example, the first grayscale is less than the second grayscale, and the first cross voltage is greater than the second cross voltage.

For example, in a case where the grayscale regulation circuit 500 includes a transistor, the transistor operates in a saturation region in a case where the light emitting circuit 400 displays the first grayscale, and the transistor operates in a linear region in a case where the light emitting circuit 400 displays the second grayscale.

For example, the light emitting stage further includes: inputting a data signal, a first scan signal and a second scan signal to turn on the data writing circuit 200 and the driving circuit 100, so that the data writing circuit 200 writes the data signal into the driving circuit 100, and the storage circuit 300 stores the data signal.

For example, for the example of the pixel circuit shown in FIG. 3, in a case where the reset circuit 600 is included, the driving method further includes an initialization stage; in the initialization stage, a reset signal is inputted to turn on the reset circuit 600, so that a reset voltage is applied to the first terminal 410 of the light emitting circuit 400.

It should be noted that the detailed description of the driving method can be referred to the description of the working principle of the pixel circuit 10 in the embodiments of the present disclosure, and details will not be repeated here.

The following statements should be noted:

(1) The accompanying drawings related to the embodiment(s) of the present disclosure involve only the structure(s) in connection with the embodiment(s) of the present disclosure, and other structure(s) can be referred to common design(s).

(2) In case of no conflict, the embodiments of the present disclosure and the features in the embodiments can be combined with each other to obtain new embodiments.

What have been described above are only specific implementations of the present disclosure, the protection scope of the present disclosure is not limited thereto. Therefore, the protection scope of the present disclosure should be based on the protection scope of the claims.

What is claimed is:

1. A pixel circuit, comprising: a driving circuit, a data writing circuit, a storage circuit and a grayscale regulation circuit, wherein the driving circuit comprises a control terminal, a first terminal and a second terminal, and is configured to control a driving current flowing through the first terminal and the second terminal and used to drive a light emitting circuit to emit light, the first terminal of the driving circuit is configured to receive a first voltage from a first voltage terminal;

the data writing circuit is connected with the control terminal of the driving circuit and is configured to write a data signal into the control terminal of the driving circuit;

the storage circuit is connected with the control terminal of the driving circuit and is configured to store the data signal written by the data writing circuit; and one terminal of the grayscale regulation circuit is connected with the second terminal of the driving circuit, another terminal of the grayscale regulation circuit is connected with a first terminal of the light emitting circuit, and the grayscale regulation circuit is configured to have a first cross voltage in a case where the light emitting circuit displays a first grayscale and to have a second cross voltage in a case where the light emitting circuit displays a second grayscale, so as to regulate a voltage of the first terminal of the light emitting circuit according to the data signal in response to a switch driving signal, wherein the first grayscale is less than the second grayscale, and the first cross voltage is greater than the second cross voltage.

2. The pixel circuit according to claim 1, wherein the light emitting circuit comprises a plurality of light emitting elements connected in series.

3. The pixel circuit according to claim 1, wherein the driving circuit comprises a first transistor, a gate electrode of the first transistor serves as the control terminal of the driving circuit, a first electrode of the first transistor serves as the first terminal of the driving circuit and is configured to be connected to the first voltage terminal to receive the first voltage, and a second electrode of the first transistor serves as the second terminal of the driving circuit.

4. The pixel circuit according to claim 1, wherein the data writing circuit comprises a second transistor and a third transistor;

a gate electrode of the second transistor is connected with a first scan line to receive a first scan signal, a first electrode of the second transistor is connected with a data line to receive the data signal, and a second electrode of the second transistor is connected with the control terminal of the driving circuit; and a gate electrode of the third transistor is connected with a second scan line to receive a second scan signal, a first electrode of the third transistor is connected with the data line to receive the data signal, and a second electrode of the third transistor is connected with the control terminal of the driving circuit.

5. The pixel circuit according to claim 1, wherein the data writing circuit comprises a second transistor or a third transistor;

a gate electrode of the second transistor is connected with a first scan line to receive a first scan signal, a first electrode of the second transistor is connected with a data line to receive the data signal, and a second electrode of the second transistor is connected with the control terminal of the driving circuit; and a gate electrode of the third transistor is connected with a second scan line to receive a second scan signal, a first electrode of the third transistor is connected with the data line to receive the data signal, and a second electrode of the third transistor is connected with the control terminal of the driving circuit.

6. The pixel circuit according to claim 1, wherein the storage circuit comprises a storage capacitor, a first electrode of the storage capacitor is connected with the control terminal of the driving circuit, and a second electrode of the storage capacitor is connected with a third voltage terminal to receive a third voltage.

7. The pixel circuit according to claim 1, wherein the grayscale regulation circuit comprises a fourth transistor, a gate electrode of the fourth transistor is connected with a switch driving signal line to receive the switch driving signal, a first electrode of the fourth transistor is connected to the second terminal of the driving circuit, and a second electrode of the fourth transistor is connected to the first terminal of the light emitting circuit.

8. The pixel circuit according to claim 1, further comprising a reset circuit, wherein the reset circuit is connected with a reset voltage terminal and the first terminal of the light emitting circuit, and is configured to apply a reset voltage to the first terminal of the light emitting circuit.

9. The pixel circuit according to claim 8, wherein the reset circuit comprises a fifth transistor, a gate electrode of the fifth transistor is connected with a reset control line to receive a reset signal, a first electrode of the fifth transistor is connected with the reset voltage terminal to receive the reset voltage, and a second electrode of the fifth transistor is connected with the first terminal of the light emitting circuit.

10. A display panel, comprising a plurality of pixel units arranged in an array, wherein each of the plurality of pixel units comprises the light emitting circuit and the pixel circuit according to claim 8.

11. A display panel, comprising a plurality of pixel units arranged in an array, wherein each of the plurality of pixel units comprises the light emitting circuit and the pixel circuit according to claim 1.

12. The display panel according to claim 11, wherein the light emitting circuit comprises the first terminal and a second terminal, and the second terminal of the light emitting circuit is configured to receive a second voltage from a second voltage terminal.

13. A driving method of pixel circuit, wherein the pixel circuit comprises a driving circuit, a data writing circuit, a storage circuit and a grayscale regulation circuit, the driving circuit comprises a control terminal, a first terminal and a second terminal, and is configured to control a driving current flowing through the first terminal and the second terminal and used to drive a light emitting circuit to emit light, the first terminal of the driving circuit is configured to receive a first voltage from a first voltage terminal;

the data writing circuit is connected with the control terminal of the driving circuit and is configured to write a data signal into the control terminal of the driving circuit;

the storage circuit is connected with the control terminal of the driving circuit and is configured to store the data signal written by the data writing circuit; and one terminal of the grayscale regulation circuit is connected with the second terminal of the driving circuit, another terminal of the grayscale regulation circuit is connected with a first terminal of the light emitting circuit, and the grayscale regulation circuit is configured to have a first cross voltage in a case where the light emitting circuit displays a first grayscale and to have a second cross voltage in a case where the light emitting circuit displays a second grayscale, so as to regulate a voltage of the first terminal of the light emitting circuit according to the data signal in response to a switch driving signal, wherein the first grayscale is less than the second grayscale, and the first cross voltage is greater than the second cross voltage; and the driving method comprises a light emitting stage;

in the light emitting stage, input the switch driving signal to turn on the grayscale regulation circuit, so that the grayscale regulation circuit has a first cross voltage in a case where the light emitting circuit displays a first grayscale, and has a second cross voltage in a case where the light emitting circuit displays a second grayscale, thereby controlling the driving current flowing through the light emitting circuit according to the data signal and applying the driving current to the light emitting circuit, wherein the first grayscale is less than the second grayscale, and the first cross voltage is greater than the second cross voltage.

14. The driving method of the pixel circuit according to claim 13, wherein the grayscale regulation circuit comprises a transistor, the transistor operates in a saturation region in a case where the light emitting circuit displays the first grayscale, and the transistor operates in a linear region in a case where the light emitting circuit displays the second grayscale.

15. The driving method of the pixel circuit according to claim 13, further comprising:

in the light emitting stage, inputting the data signal, a first scan signal and a second scan signal to turn on the data writing circuit and the driving circuit, so that the data writing circuit writes the data signal into the driving circuit, and the storage circuit stores the data signal.

16. The driving method of the pixel circuit claim 13, further comprising an initialization stage in a case where the pixel circuit comprises a reset circuit, wherein in the initialization stage, input a reset signal to turn on the reset circuit, so that a reset voltage is applied to the first terminal of the light emitting circuit.

* * * * *